US011847899B1

(12) United States Patent
Al-Ali

(10) Patent No.: US 11,847,899 B1
(45) Date of Patent: Dec. 19, 2023

(54) SUMPS GAS MONITORING SYSTEM

(71) Applicant: SAUDI ARABIAN OIL COMPANY, Dhahran (SA)

(72) Inventor: Talal M. Al-Ali, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/807,566

(22) Filed: Jun. 17, 2022

(51) Int. Cl.
*G08B 21/12* (2006.01)
*G08B 3/00* (2006.01)

(52) U.S. Cl.
CPC ..... *G08B 21/12* (2013.01); *G08B 3/00* (2013.01)

(58) Field of Classification Search
CPC ..... G08B 21/12
See application file for complete search history.

(56) References Cited

U.S. PATENT DOCUMENTS 6,799,112 B1 9/2004 Carter et al.
2004/0035184 A1* 2/2004 Yamano ..... G08B 17/113 340/630
2011/0050433 A1* 3/2011 Luterotti ..... G08B 17/10 340/628

* cited by examiner

*Primary Examiner* — Travis R Hunnings
(74) *Attorney, Agent, or Firm* — Osha Bergman Watanabe & Burton LLP

(57) ABSTRACT

A system includes a depression, a liquid, a gas inlet, an aspiration system, an aspirator, and a gas detector. The depression is formed into a floor. The liquid is disposed within the depression. An unoccupied space is delineated by a surface level of the liquid and a depth of the depression in the floor. The gas inlet is located within the unoccupied space in the depression. the aspiration system is connected to the gas inlet by a tube and located outside of the depression. The aspirator is located within the aspiration system and configured to create a vacuum to draw a gas mixture from the unoccupied space into the aspiration system using the gas inlet and the tube. The gas detector is located within the aspiration system and is configured to detect a specific gas.

20 Claims, 3 Drawing Sheets

SUMPS GAS MONITORING SYSTEM

BACKGROUND

Sumps are atmospheric vessels that collect fluids. Sumps are commonly found at various work sites, such as on oil and gas drilling rigs, production platforms, or onshore well sites. Sumps are often located below ground at the lowest point of a work site. As such, the fluid that accumulates in a sump is often runoff or drainage water from the worksite. Further, a sump may be created to observe or collect fluids that come from an oil and gas well. On oil and gas work sites in particular, sump tanks could accumulate dangerous gases such as explosive gases or hydrogen sulfide. If these gases accumulate to high enough concentrations, human safety is put at risk.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure present, in accordance with one or more embodiments, systems and methods for detecting specific gases within a depression. The systems of one or more embodiments include the depression, a liquid, a gas inlet, an aspiration system, an aspirator, and a gas detector. The depression is formed into a floor. The liquid is disposed within the depression. An unoccupied space is delineated by a surface level of the liquid and a depth of the depression in the floor. The gas inlet is located within the unoccupied space in the depression. the aspiration system is connected to the gas inlet by a tube and located outside of the depression. The aspirator is located within the aspiration system and configured to create a vacuum to draw a gas mixture from the unoccupied space into the aspiration system using the gas inlet and the tube. The gas detector is located within the aspiration system and is configured to detect a specific gas.

The methods of one or more embodiments include disposing a liquid into a depression formed into a floor and placing a gas inlet into an unoccupied space of the depression. The method also includes activating an aspirator in an aspiration system to create a vacuum within the aspiration system and drawing a gas mixture from the unoccupied space into the aspiration system using the vacuum. The method further includes detecting a specific gas from the gas mixture pulled from the unoccupied space using a gas detector located in the aspiration system.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
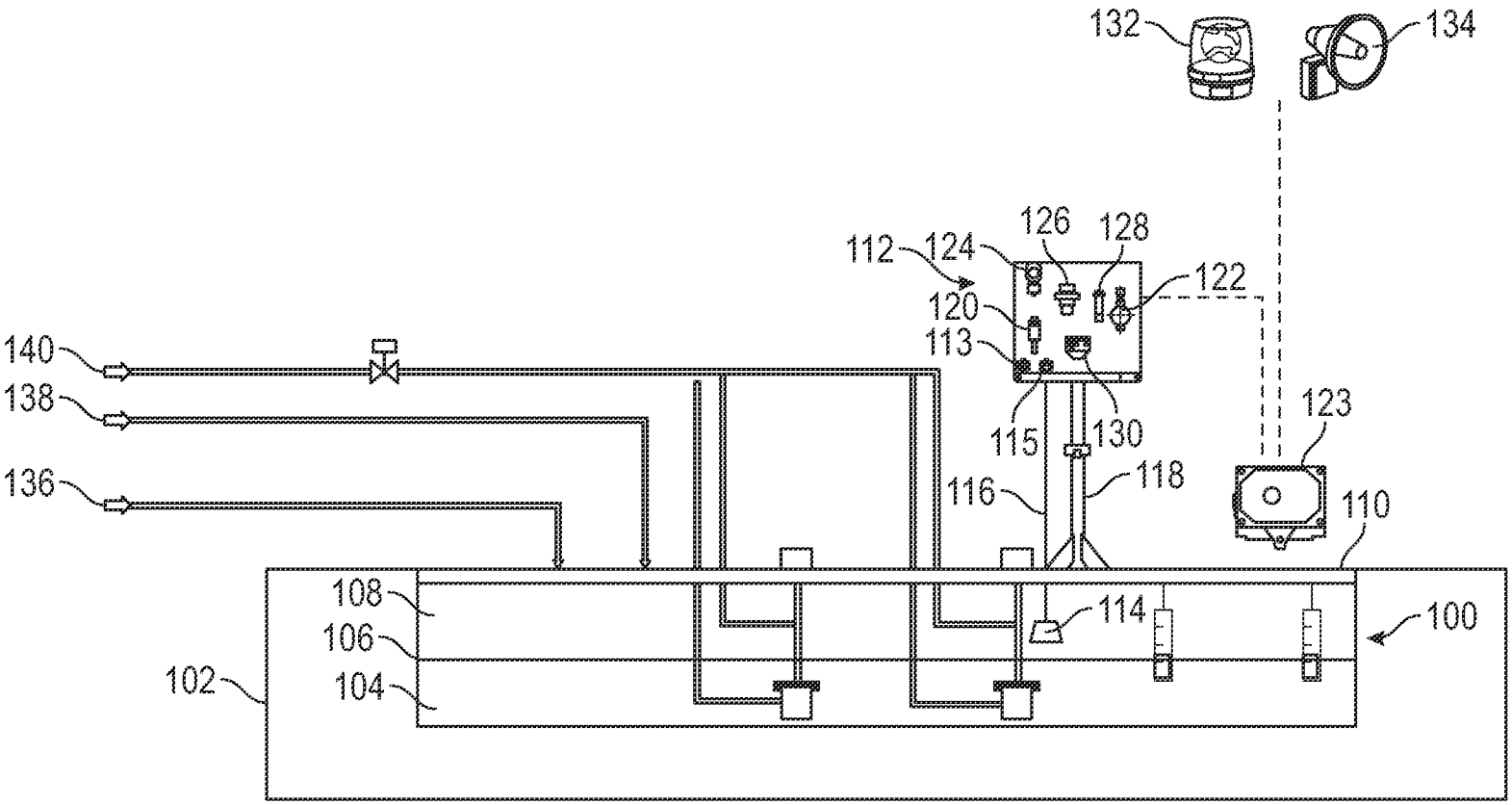
FIG. 1 shows a sump system in accordance with one or more embodiments.

FIG. 1 shows a sump (100) system in accordance with one or more embodiments. The sump (100) is a depression that has been formed into a floor (102). The sump (100) is shown as a rectangular shape; however, the sump (100) may have any shape without departing from the scope of the disclosure herein. The floor (102) may be a man-made floor such as a platform or a drilling rig. In other embodiments, the floor (102) may be a natural-made floor such as the Earth' surface. A liquid (104) is shown accumulated within the sump (100); however, the sump (100) may be absent of a liquid (104) without departing from the disclosure herein. The liquid (104) may be any liquid such as water, hydrocarbons, a mixture of water and hydrocarbons, etc. The height of the liquid (104) in the sump (100) defines a liquid level (106).

The space located between the liquid level (106) and the height of the floor (102) is the unoccupied space (108). Thus, the unoccupied space (108) is delineated by the liquid level (106) of the liquid (104) and the height of the floor (102). In the absence of a liquid (104) and a liquid level (106), the unoccupied space (108) takes up the entirety of the sump (100). The term "unoccupied" is not meant to be limiting, rather, the unoccupied space (108) could be occupied with air or other gases like carbon dioxide, hydrogen sulfide, explosive gases, etc.

The sump (100) may be open to the atmosphere with no cover. In other embodiments, the sump (100) may be partially or completely covered by a platform (110). In accordance with one or more embodiments, the platform (110) extends across the sump (100) and is level with, close to level with, or rests on the floor (102). The platform (110) may be a solid piece of material, or the platform (110) may have a plurality of gaps/holes. Further, the platform (110) may have one or more access points to the sump (100) that will allow for various pieces of equipment to access the unoccupied space (108) or liquid (104) in the sump (100). The platform (110) may be made out of any material known in the art, such as a canvas-like material or a ridged material like wood or steel. In further embodiments, the sump (100) may be lined with a material, such as plastic, that prevents the liquid (104) from escaping the sump (100) and being absorbed into the floor (102).

Due to the tenancy for harmful gases such as explosive gases or hydrogen sulfide to accumulate within the unoccupied space (108) of the sump (100), the present disclosure outlines a continuous gas monitoring system that may be installed and used to monitor gas accumulation within the sump (100). The gas monitoring system includes an aspiration system (112) and a gas inlet (114). The gas inlet (114) is located within the unoccupied space (108) of the sump (100) and is connected to the aspiration system (112) through a tube (116). The tube (116) may be made out of any material in the art and may be ridged or flexible without departing from the scope of the disclosure herein. Further, the gas inlet (114) may be a simple opening in the tube (116), or the gas inlet (114) may be a more complex valve system. The aspiration system (112) is located outside of the sump (100).

In accordance with one or more embodiments, the platform (110) may be made out of a ridged material, the aspiration system (112) may sit on the platform, and the tube (116) may extend through the platform (110) into the sump (100). In other embodiments, the aspiration system (112) may sit on the floor (102) and the tube (116) may extend from the aspiration system (112) into the sump (100). In further embodiments, the aspiration system (112) may include a stand (118) that elevates the aspiration system (112) off of the platform (110) or the floor (102).

In further embodiments, the aspiration system (112) includes an aspirator (120), a gas detector (122), an instrument air regulator (124), a multi-coated (MC) filter (126), a flow meter (128), and a valve (130). Further, the aspiration system (112) includes an air inlet (113), configured to allow air into the aspiration system (112), and a system outlet (115), configured to release the air and the gas mixture from the aspiration system (112).

The aspirator (120) creates a vacuum within the aspiration system (112). The vacuum draws a gas mixture from the unoccupied space (108) into the aspiration system (112) using the gas inlet (114) and the tube (116). The instrument air regulator (124) aids in creating the vacuum by regulating the amount of air flowing into the aspiration system (112) using the air inlet (113). Further, the instrument air regulator (124) may regulate the air and the gas mixture flowing out of the system outlet (115).

In accordance with one or more embodiments, the aspirator (120) is a type of ejector-jet pump that produces a vacuum using the Venturi effect. Specifically, air is drawn into the aspiration system (112) from an instrument air supply (not pictured) using the instrument air regulator (124). The air flows through a tube that narrows and then expands in terms of cross-sectional area and volume. When the tube narrows, the air's pressure decreases causing the vacuum.

When the gas mixture first enters the aspiration system (112), the gas mixture may pass through the MC filter (126) to filter out dust and other suspended impurities in order to protect the gas detector (122). The flow meter (128) may be any type of flow meter known in the art and is used to monitor the flow rate of the gas mixture being drawn into the aspiration system (112). The valve (130) may be a three-way valve (130) used for bypass purposes.

The gas detector (122) is configured to detect one or more specific gases within the gas mixture drawn from the unoccupied space (108). The gas detector (122) detects the specific gas(es) by using sensors. For example, the sensors may include lower explosives limit (LEL) sensors or hydrogen sulfide sensors. Further, the gas detector (122) may have any combination of one or more types of sensors without departing from the scope of the disclosure herein.

In accordance with one or more embodiments, the gas detector (122) includes an LEL sensor, and the aspiration system (112) is in electronic communication with an LEL transmitter (123). The aspiration system (112) may be connected to the LEL transmitter (123) using an electronically conductive cable, or the aspiration system (112) may be connected wirelessly to the LEL transmitter (123). Further, the LEL transmitter (123) may be part of the gas detector (122) without departing from the scope of this disclosure herein.

In further embodiments, the LEL transmitter (123) may be in electronic communication, either wirelessly or through a wire, to an LEL beacon (132) and/or a horn (134). When the LEL transmitter (123) detects the presence of explosive gases or receives a signal from the LEL sensor in the gas detector (122), a signal is transmitted to the LEL beacon (132) and the horn (134). Upon reception of the signal, the LEL beacon flashes, or continuously shines a light, and the horn (134) emits a noise in order to alert a person to the presence of explosive gases.

In further embodiments, the sump (100) system may include a neutralization system that may be activated to neutralize the specific gases detected by the gas detector (122). The neutralization system may include one or more of a nitrogen supply line (136), a demineralized water supply line (138), and an amine gas supply line (140). The supply lines (136, 138, 140) may be connected to storage tanks (not pictured) containing nitrogen, demineralized water, and an amine gas, respectively.

The supply lines (136, 138, 140) may extend from the storage tanks to the sump (100) such that the nitrogen, demineralized water, and/or amine gas may be deposited into the sump (100). In accordance with one or more embodiments, the amine gas may be lean Diglycolamine (DGA). The amine gas may be used to treat the gas mixture for hydrogen sulfide. The nitrogen and water may be used to neutralize other explosive gases such as Methane.

Figure 2:
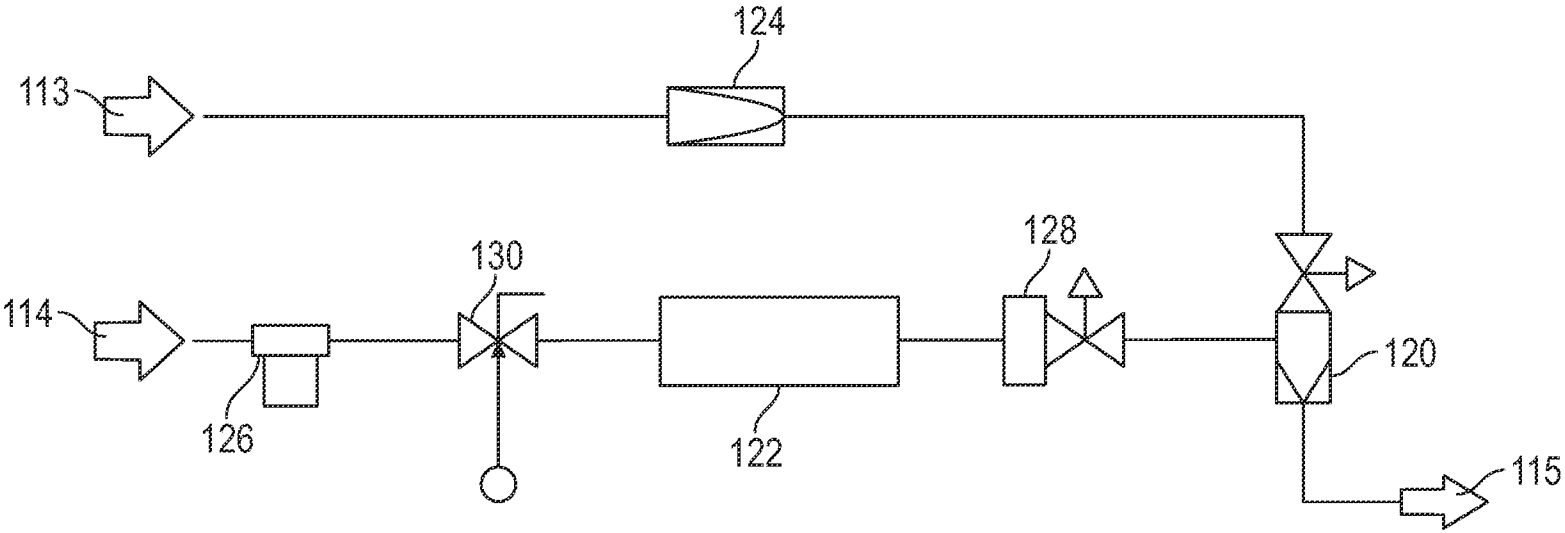
FIG. 2 shows an operational diagram of the aspiration system as described above and in accordance with one or more embodiments.

FIG. 2 shows an operational diagram of the aspiration system (112) as described above and in accordance with one or more embodiments. The instrument air regulator (124) pulls air through the air inlet (113) and pumps the air into the aspirator (120) to create a vacuum. The vacuum causes the gas mixture from the unoccupied space (108) in the sump (100) to be sucked into the gas inlet (114).

From the gas inlet (114), the gas mixture travels through the MC filter (126). The MC filter (126) filters out dust and other suspended impurities, e.g., larger than 0.3 micrometers, from the gas mixture in order to protect the gas detector (122). The gas mixture travels from the MC filter (126) through the valve (130), into the gas detector (122), into the flow meter (128) and into the aspirator (120). Within the aspirator (120), the air and the gas mixture mix, and the air and the gas mixture are expelled from the aspiration system (112) using the system outlet (115). The system outlet (115) may be connected to a method of disposal such as a flare stack, a return pipe, or a pit.

Figure 3:
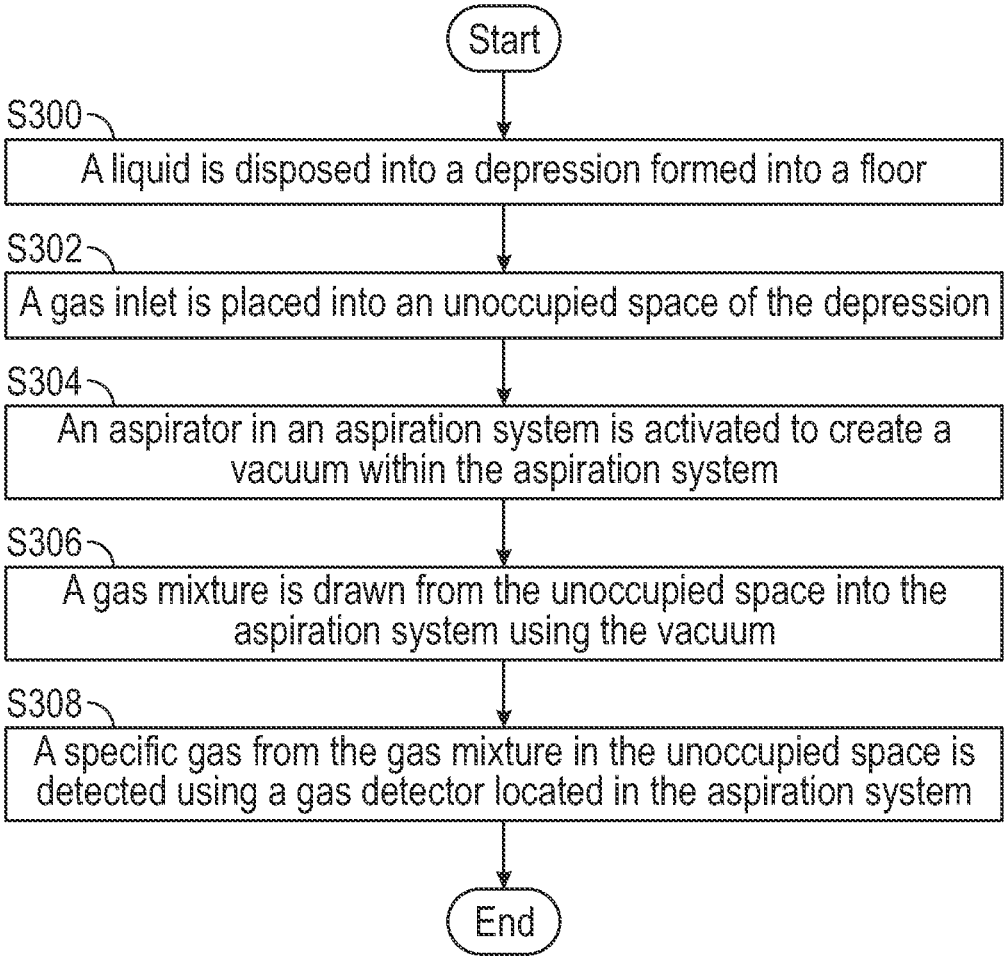
FIG. 3 shows a flowchart in accordance with one or more embodiments.

FIG. 3 shows a flowchart in accordance with one or more embodiments. The flowchart outlines a method for detecting and neutralizing gas located in a sump (100) system. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a liquid (104) is disposed into a depression formed into a floor (102) (S300). In accordance with open or more embodiments, the depression may be a sump (100) as described above. The liquid (104) may be disposed in the sump (100) through water drainage, or the liquid (104) may be disposed in in the sump (100) using pipes. A gas inlet (114) is placed into an unoccupied space (108) of the depression (S302). The gas inlet (114) may be placed into the unoccupied space (108) using a tube. The tube (116) is connected to an aspiration system (112).

An aspirator (120) in the aspiration system (112) is activated to create a vacuum within the aspiration system (112) (S304). A gas mixture is drawn from the unoccupied space (108) into the aspiration system (112) using the vacuum (S306) and the tube (116). The vacuum may be created by drawing in air from the atmosphere using an air inlet (113) and an instrument air regulator (124). The instrument air regulator (124) regulates the air flow into the aspiration system (112) which, in turn, regulates the gas mixture flow into the aspiration system (112). Further, the instrument air regulator (124) may regulate air and gas mixture flow out of the aspiration system (112).

A specific gas from the gas mixture in the unoccupied space (108) is detected using a gas detector (122) located in the aspiration system (112) (S308). The specific gas may have designated LEL levels that categorize it as explosive, and the specific gas may be detected by activating an LEL sensor in the gas detector (122). The LEL sensor is activated by detecting said LEL levels. Upon activation of the LEL sensor, a signal may be sent to an LEL transmitter (123). The LEL transmitter (123) may set off an LEL beacon (132) and/or an LEL horn (134). Upon detection of the specific gas from the gas mixture, nitrogen, demineralized water, or an amine gas may be pumped into the depression using a nitrogen supply line (136), a demineralized water supply line (138), or an amine gas supply line (140), respectively, in order to neutralize the specific gas.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

a depression formed into a floor;

a liquid disposed within the depression;

an unoccupied space delineated by a surface level of the liquid and a depth of the depression in the floor;

a gas inlet located within the unoccupied space in the depression;

an aspiration system connected to the gas inlet by a tube and located outside of the depression;

an aspirator located within the aspiration system and configured to create a vacuum to draw a gas mixture from the unoccupied space into the aspiration system using the gas inlet and the tube; and a gas detector located within the aspiration system and configured to detect a specific gas.

2. The system of claim 1, wherein the gas detector comprises a lower explosive limit (LEL) sensor, and wherein the LEL sensor is activated based on detecting the specific gas.

3. The system of claim 2, further comprising an LEL transmitter in electronic communication with the LEL sensor in the aspiration system and configured to transmit a signal based on activation of the LEL sensor.

4. The system of claim 3, further comprising a LEL beacon in electronic communication with the LEL transmitter and configured to be set off based on receipt of the signal from the LEL transmitter.

5. The system of claim 3, further comprising a horn in electronic communication with the LEL transmitter and configured to be set off upon receipt of the signal from the LEL transmitter.

6. The system of claim 2, wherein the gas detector further comprises a hydrogen sulfide sensor.

7. The system of claim 1, wherein the aspiration system further comprises an air inlet configured to allow air into the aspiration system and a system outlet configured to release the air and the gas mixture from the aspiration system.

8. The system of claim 7, wherein the aspiration system further comprises an instrument air regulator configured to regulate the air flowing through the air inlet and to regulate the gas mixture and the air flowing out of the system outlet.

9. The system of claim 7, wherein the system outlet is connected to a flare stack, a return pipe, or a pit.

10. The system of claim 1, further comprising a platform covering the depression.

11. The system of claim 10, wherein the aspiration system is disposed on the platform.

12. The system of claim 1, further comprising a nitrogen supply line, a demineralized water line, or an amine gas line disposed within the depression.

13. A method comprising:

disposing a liquid into a depression formed into a floor;

placing a gas inlet into an unoccupied space of the depression;

activating an aspirator in an aspiration system to create a vacuum within the aspiration system;

drawing a gas mixture from the unoccupied space into the aspiration system using the vacuum; and detecting a specific gas from the gas mixture pulled from the unoccupied space using a gas detector located in the aspiration system.

14. The method of claim 13, wherein the gas detector comprises a lower explosive limit (LEL) sensor.

15. The method of claim 14, wherein detecting the specific gas further comprises activating the LEL sensor.

16. The method of claim 15, wherein activating the LEL sensor further comprises transmitting a signal to a LEL transmitter.

17. The method of claim 16, wherein transmitting the signal to the LEL transmitter further comprises setting off a LEL beacon.

18. The method of claim 16, wherein transmitting the signal to the LEL transmitter further comprises setting off a horn.

19. The method of claim 13, wherein activating the aspirator further comprises regulating air and gas mixture flow into and out of the aspiration system using an instrument air regulator.

20. The method of claim 13, wherein detecting the specific gas from the gas mixture further comprises pumping nitrogen, demineralized water, or an amine gas into the depression using a nitrogen supply line, a demineralized water line, or an amine gas line, respectively, in order to neutralize the specific gas.

* * * * *